US006283101B1

(12) United States Patent
Hülsmann et al.

(10) Patent No.: US 6,283,101 B1
(45) Date of Patent: Sep. 4, 2001

(54) METHOD OF CONTROLLING EXHAUST RECYCLING IN AN INTERNAL COMBUSTION ENGINE

(75) Inventors: Bernd Hülsmann, Langenfeld; Martin Lutat, Augustin, both of (DE)

(73) Assignee: Deutz AG, Cologne (DE)

( * ) Notice: Subject to any disclaimer, the term of this patent is extended or adjusted under 35 U.S.C. 154(b) by 0 days.

(21) Appl. No.: 09/486,162

(22) PCT Filed: May 30, 1998

(86) PCT No.: PCT/EP98/03254

§ 371 Date: Feb. 22, 2000

§ 102(e) Date: Feb. 22, 2000

(87) PCT Pub. No.: WO99/10644

PCT Pub. Date: Mar. 4, 1999

(30) Foreign Application Priority Data

Aug. 22, 1997 (DE) ..... 197 36 522

(51) Int. Cl.[7] ..... F02M 25/07

(52) U.S. Cl. ..... 123/568.21; 701/108

(58) Field of Search ..... 123/568.11, 568.12, 123/568.21, 568.23, 568.24, 568.25, 568.26, 568.27, 568.28; 701/108

(56) References Cited

U.S. PATENT DOCUMENTS 4,455,987 6/1984 Sudbeck ..... 123/568.27
4,762,107 * 8/1988 Schoneck et al. ..... 123/568.21
5,063,510 * 11/1991 Jurgens et al. ..... 701/108
5,682,864 * 11/1997 Shirakawa ..... 123/568.21

FOREIGN PATENT DOCUMENTS 44 35 420 10/1994 (DE) .
196 44 102 10/1996 (DE) .
56-027055 3/1981 (JP) .
60-192870 1/1985 (JP) .

* cited by examiner

*Primary Examiner*—Willis R. Wolfe
(74) *Attorney, Agent, or Firm*—Charles L. Schwab; Hardaway/Mann IP Group Nexsen Pruet Jacobs & Pollard, LLC

(57) ABSTRACT

The invention relates to a method for controlling exhaust gas recirculation in an internal combustion engine. Known methods provide for a control unit which generally controls the exhaust gas recirculation rate via a throttle and a stop valve in accordance with operating parameters of the internal combustion engine. No further information is provided on these operating parameters. The invention provides for a method and a device for controlling exhaust gas recirculation in an internal combustion engine which method and device are able to take into consideration a wide range of operating conditions of an internal combustion engine. To this end the control unit comprises a basic characteristic map (1) above the parameters "rotation per mite of international combustion engine" and "quantity of fuel supplied per operating cycle". The basic signals of the basic characteristic map (1) can be influenced by correcting units which can be connected as needed and transmit correcting signals.

15 Claims, 1 Drawing Sheet

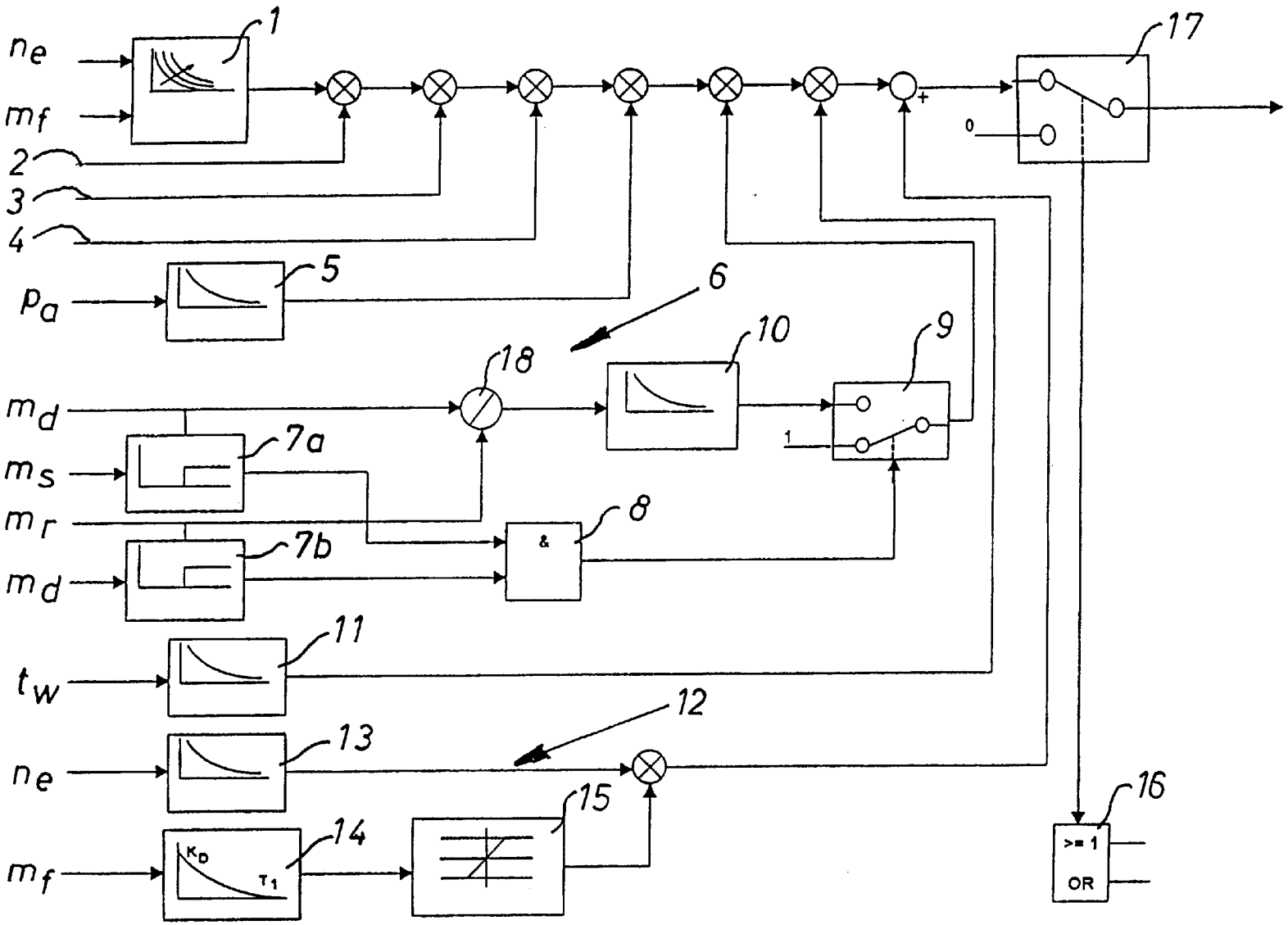
17
16
≥1
OR
9
10
6
8
&
12
15
18
1
5
7a
7b
11
13
14
$K_D$
$T_1$
$n_e$
$m_f$
2
3
4
$p_a$
$m_d$
$m_s$
$m_r$
$m_d$
$t_w$
$n_e$
$m_f$

METHOD OF CONTROLLING EXHAUST RECYCLING IN AN INTERNAL COMBUSTION ENGINE

TECHNICAL FIELD

This invention relates to a method and a device for controlling exhaust gas recirculation in an internal combustion engine, in particular a compression-ignition internal combustion engine, which has a crankcase, at least one cylinder and one cylinder head with an intake duct and an exhaust duct connectable via an exhaust gas recirculation duct, the rate of exhaust gas recirculation being controlled by a control device in dependence on operating parameters of the internal combustion engine, the control device having a basic characteristic map with the parameters speed $n_e$ of internal combustion engine and quantity $m_f$ of fuel delivered per working cycle and further a vehicle acceleration correction device generating a vehicle acceleration correction signal, and the base signals of the basic characteristic map being modifiable by correction devices that are engageable as necessary and generate correction signals.

BACKGROUND OF THE INVENTION

Such a method is known from German patent document DE-A 196 31 112, published Feb. 6, 1997, T. Shirakawa, inventor. According to this document, a control device for an internal combustion engine is made such that, upon detection of a change in the operating conditions of the engine or upon an acceleration, a retardation of the fuel injection timing control is predicted. In coincidence with a difference between an actual fuel injection time and the predicted nominal fuel injection time, a nominal exhaust gas recirculation range, that is, a quantity or rate of exhaust gas recirculation, is corrected.

OBJECTS AND SUMMARY OF THE INVENTION

It is an object of this invention to provide a method and a device for controlling exhaust gas recirculation in an internal combustion engine, which can take account of the most varied service conditions of an internal combustion engine.

This object is achieved by virtue of the fact that the vehicle acceleration correction signal is applied multiplicatively to the base signal, that the vehicle acceleration correction device takes account of the parameters a) injection pump controller setpoint, b) gas pedal position, c) controller setpoint corresponding to smoke limit, and that if b)>a) and a)>c), a disturbance variable is present, which correspondingly takes account of the evaluated parameters a) and c). Stored in the basic characteristic map are characteristic curves in terms of the above-cited parameters, which establish the base signals. At least in certain services of the internal combustion engine, exhaust gas recirculation can be controlled with these base signals alone, provision also being made that an "emergency program" is run in accordance with the base signals in case, for example, of a malfunction due to, for example, defective sensors for one or several correction devices. According to the present invention, in most applications of the internal combustion engine, the basic characteristic map is modified as necessary by correction devices generating correction signals. Thus provision is advantageously made for generally storing in the basic characteristic map the exhaust gas recirculation values for various internal combustion engines, these base signals then being subject to modification depending on the model and version of the internal combustion engine (cylinder number, power setting, etc.) and the other correction devices described in what follows. This design makes it possible always to use the same device and to keep the diversity of parts low. There is always a vehicle acceleration correction device that takes account of the parameters injection pump controller setpoint, gas pedal position and smoke limit. The current gas pedal position is then compared with the injection pump controller setpoint in one comparator, and the smoke limit is compared with the injection pump controller setpoint in one comparator. If the comparison in both comparators yields the result that specifiable settings are being exceeded, the output signal in each case is identified as a disturbance variable, the two output disturbance variables being combined in an AND element. In other words, only if a disturbance variable is present at both comparators is a further switch downstream of the AND element actuated. At the same time, the injection pump controller setpoint and the smoke limit are input to a divider and, according to the resulting value, a value for the degree of closure of the exhaust gas recirculation is derived from a subsequent evaluation curve. This value is then applied multiplicatively to the base signal if the presence of a disturbance variable is signaled to the aforementioned switch.

In development of the invention, there is a use correction device, which generates a use correction signal which is applied multiplicatively to the base signal. This use correction device thus quite generally takes account of the specified intended use of the internal combustion engine and establishes correction signals for such use, with which the base signals are superposed. Possible intended uses are, for example, the use of the internal combustion engine in a vehicle, an agricultural machine, a construction machine, or an implement.

In development of the invention, there is an internal combustion engine acceptance correction device, which likewise generates appropriate correction signals. Basic correction values are consequently stored in this correction device during the internal combustion engine acceptance procedure after manufacture and assembly, which correction values are quite specially tailored to the particular internal combustion engine acceptance procedure. These are understood to be basic values as to the model and version of the internal combustion engine.

Further, there is a vehicle data correction device. In this, relevant vehicle data, such as for example vehicle data and service field, can then be stored.

Further, there is an ambient pressure correction device, which finds use in particular when the internal combustion engine or the vehicle is in service in mountains.

In development of the invention, there is a coolant temperature correction device, which takes account of the internal combustion engine coolant temperature in controlling the exhaust gas recirculation.

Moreover, there is a dynamic correction device, which takes account of the mode of driving of the operator of a vehicle. This dynamic correction signal incorporates the speed of the internal combustion engine and the quantity of fuel delivered per working cycle, these both being used to determine whether a steady driving state or an extreme driving mode (continual alteration of gas pedal between zero position and full-load position) is in effect. If the presence of dynamic operation is identified in this device, a correction value is added to the base signal in the case of this device, in contrast to the signals mentioned above.

Downstream of all these correction devices is a device that verifies whether the engine brake of the vehicle is engaged. If so, exhaust gas recirculation is automatically reduced to zero or shut off entirely. Exhaust gas recirculation is likewise shut off during starting operation.

BRIEF DESCRIPTION OF THE DRAWINGS

Further advantageous developments of the invention can be inferred from the description of the drawing, in which an exemplary embodiment of the invention is described in more detail.

DETAILED DESCRIPTION OF THE INVENTION

Stored in basic characteristic map 1 are various characteristics, by which every individual point of the characteristic establishes a certain rate of exhaust gas recirculation. This individual point is determined by the input variables "speed $n_e$ of the internal combustion engine" and "quantity $m_f$ of fuel delivered to the internal combustion engine per working cycle." In the present case, the quantity $m_f$ of fuel delivered per working cycle is defined as the quantity of fuel delivered per stroke of one of the injection pump elements of the internal combustion engine. The base output signal from this basic characteristic map 1 determines the quantity of exhaust gas recirculation in dependence on the input variables mentioned. This base signal can be modified by the correction devices explained in what follows, which generate corresponding correction signals, and thus the actual rate of exhaust gas recirculation can be adapted to given operating conditions of the internal combustion engine.

First there is an adaptation by three correction devices that take account of the basic parameters in the operation of the internal combustion engine and are applied multiplicatively to the base signal. The first is an internal combustion engine use correction device 2, which generates a corresponding internal combustion engine use correction signal in accordance with the power group and/or the intended use of the internal combustion engine, for example in a commercial vehicle, in an agricultural machine, in a construction vehicle or an implement. This corresponding signal can be stored in a central electronic control device, in which the entire system can be integrated. The same holds for an internal combustion engine acceptance correction device 3, which generates a corresponding correction signal created during the acceptance procedure of the internal combustion engine. This correction signal can be modified in particular by, among others, data specific to the internal combustion engine, such as number of cylinders, type of injection device and so forth. Further, a tolerance compensation of the exhaust gas recirculation system is effected herewith. The corresponding correction signal is likewise applied multiplicatively to the output signal of the basic characteristic map. Finally, there is a vehicle data correction device 4, which generates a vehicle-specific correction signal. Relevant vehicle-specific data, such as for example data on the particular intake and exhaust system, but also, as appropriate, vehicle weight, transmission ratios and application area (for example construction site, short-haul traffic or long-haul traffic), can come into play in this correction device.

Further, there is an ambient pressure correction device 5, in which a correction curve depending on the measured ambient pressure $p_a$ is stored. Here,in particular, the decline in ambient pressure $p_a$ with increasing altitude, which has a direct effect on the charging of the internal combustion engine and thus on combustion, is taken into account.

Moreover, there is a vehicle acceleration correction device 6, which processes various input signals explained in what follows and finally generates a corresponding correction signal, which represents an acceleration rating. At the input of the vehicle acceleration correction device there are two comparators 7*a*, 7*b*, a measured value $m_s$ for the gas pedal position being input to comparator 7*a* and compared with an injection pump controller setpoint $m_d$, which represents a torque limit, and an output signal being generated in case of exceedance. The injection pump controller setpoint $m_d$ is directly input to comparator 7*b*, here being compared with a controller setpoint $m_r$ that corresponds to a smoke limit, and an output signal also being generated from comparator 7*b* in case of exceedance. The output signals of the two comparators 7*a*, 7*b* are combined in an AND element 8, the AND element generating a switch signal if a disturbance variable—corresponding to an output signal—is present from both comparators 7*a* and 7*b*. This switch signal is led to a control element 9, control element 9 connecting the output of control element 9 to a 0 input, whose input signal is described in what follows, if an output signal from the AND element 8 is present. In case neither or just one of comparators 7*a*, 7*b* generates a disturbance signal and accordingly AND element 8 reports no disturbance variable, the input of control element 9 is switched to the 1 input, so that no vehicle acceleration correction signal is generated. In case a correction signal is generated, this signal is determined from the injection pump controller setpoint $m_d$ and the controller setpoint $m_r$, both connected to each other by a divider 18 and being input to an evaluation device 10. This evaluation device 10 exhibits a characteristic that establishes the degree of closure of the exhaust gas recirculation in dependence on the input signal. As already explained, the output signal of evaluation device 10, as the vehicle acceleration correction signal, is applied multiplicatively, via control element 9, to the output signal of basic characteristic map 1.

Further, there is an internal combustion engine coolant temperature correction device 11, to which the current coolant temperature $t_w$ is input and which determines and generates a correction signal from a correction curve. If appropriate, it can also be determined here whether the internal combustion engine is in the warmup phase after a cold start.

Finally, there is a dynamic correction device 12, which likewise generates a correction signal, which, however, is applied additively to the base signal, in contrast to the previous signals. This correction value is derived from the speed $n_e$ of the internal combustion engine and the mass $m_f$ of fuel delivered per working cycle, the speed $n_e$ of the internal combustion engine being supplied to a speed-dependent correction characteristic 13 and the mass $m_f$ of fuel delivered being supplied to a damped differentiating element 14. The output signal of the damped differentiating element 14 is further led to a minimum/maximum limiter 15, values between 0 and 1 being generated as output values. Here the value 0 represents a steady driving mode and the value 1 represents an extreme driving mode. The value 0 can be compared with a calm driving mode with a constant gas pedal position, while the value 1 can be compared with a very erratic driving mode with a continually moving accelerator pedal. All values between 0 and 1 are permitted and are processed.

Finally, there is also a device 16 that takes account of whether the engine brake is engaged or disengaged or whether a starting operation is in effect. If the engine brake is engaged or a motor start is in progress, changeover switch 17 is set to the 0 input, so that exhaust gas recirculation is likewise not in effect during these operating conditions.

What is claimed is:

1. Apparatus for controlling exhaust gas recirculation in a compression ignition internal combustion engine, having an injection pump controller, an engine speed control, a crankcase, at least one cylinder and one cylinder head with intake and exhaust ducts interconnected by an exhaust gas recirculating duct with flow controlled by a control device in dependence on operating parameters of the internal combustion engine, said control device comprising:

a basic characteristic map with the parameters including internal combustion engine speed $n_e$ and quantity $m_f$ of fuel delivered per working cycle, an engine acceleration correction device generating an engine acceleration correction signal, said base signal of said basic characteristic map being modified by correction devices generating correction signals, said engine acceleration correction signal being responsive to the parameters including a) injection pump controller setpoint b) speed control position, c) injection pump controller setpoint corresponding to smoke limit, said correction signal bing applied multiplicatively to said base signal and wherein if b)>a) and a)>c), a disturbance variable is present, which is taken into account in correspondence with said evaluated parameters a) and c).

2. A method of controlling exhaust gas recirculation in a compression-ignition internal combustion engine having a crankcase, at least one cylinder and one cylinder head with an intake duct and an exhaust duct connectable via an exhaust gas recirculating duct, the rate of exhaust gas recirculating being controlled by a control device in dependence on operating parameters of the internal combustion engine, the control device having a basic characteristic map with the parameters internal combustion engine speed $n_2$ and quantity $m_f$ of fuel delivered per working cycle, and the base signal of said basic characteristic map being modifiable by correction devices that are engageable as necessary and which generate correction signals, characterized in that a vehicle acceleration correction signal is applied multiplicatively to the base signal and the vehicle acceleration device (6) is provided which takes account of the parameters a) injection pump controller setpoint, b) gas pedal position, c) controller setpoint corresponding to smoke limit and that if b)>a) and a)>c), a disturbance variable is present, which is taken into account in correspondence with the evaluated parameters a) and c).

3. Method according to claim 2, characterized in that an internal combustion engine acceptance correction device (3) is provided which generates an internal combustion engine acceptance correction signal which is applied multiplicatively to said base signal.

4. Method according to claim 2 characterized in that a vehicle data correction device (4) is provided which generates a vehicle data correction signal which is applied multiplicatively to said base signal.

5. Method according to claim 2 characterized in that an ambient pressure correction device (5) is provided which generates an ambient pressure correction signal which is applied multiplicatively to said base signal.

6. Method according to claim 2 characterized in that an internal combustion engine coolant temperature correction device (11) is provided which generates an internal combustion engine coolant temperature correction signal which is applied multiplicatively to said base signal.

7. Method according to claim 2 characterized in that a dynamic correction device (12) is provided which generates a dynamic correction signal which is applied multiplicatively to a speed signal and this dynamic-speed correction signal is applied additively to said base signal.

8. Method according to claim 2, characterized in that said engine is provided with an engine brake and exhaust gas recirculating is stopped when said engine brake is activated and when said engine is started.

9. Method according to claim 2, characterized in that an internal combustion engine use correction device (2) is provided which generates an internal combustion engine use correction signal which is applied multiplicatively to said base signal.

10. Method according to claim 9, characterized in that an internal combustion engine acceptance correction device (3) is provided which generates an internal combustion engine acceptance correction signal which is applied multiplicatively to said base signal.

11. Method according to claim 10 characterized in that a vehicle data correction device (4) is provided which generates a vehicle data correction signal which is applied multiplicatively to said base signal.

12. Method according to claim 11 characterized in that an ambient pressure correction device (5) is provided which generates an ambient pressure correction signal which is applied multiplicatively to said base signal.

13. Method according to claim 12 characterized in that an internal combustion engine coolant temperature correction device (11) is provided which generates an internal combustion engine coolant temperature correction signal which is applied multiplicatively to said base signal.

14. Method according to claim 13 characterized in that a dynamic correction device (12) is provided which generates a dynamic correction signal which is applied multiplicatively to a speed signal and this dynamic-speed correction signal is applied additively to said base signal.

15. Method according to claim 14, characterized in that said engine is provided with an engine brake and exhaust gas recirculating is stopped when said engine brake is activated and when said engine is started.

* * * * *